United States Patent [19]

Longuet et al.

[11] Patent Number: 4,908,991

[45] Date of Patent: Mar. 20, 1990

[54] GRINDING MACHINES

[75] Inventors: Raynald G. M. Longuet, Le Gros Thiel; Jean-Pierre M. F. Langlois, Rouen, both of France

[73] Assignee: Briot International, Elbeue, France

[21] Appl. No.: 360,233

[22] Filed: Jun. 1, 1989

[30] Foreign Application Priority Data

Jun. 14, 1988 [FR] France ..... 88 07915

[51] Int. Cl.[4] ..... B24B 5/00; B24B 7/00

[52] U.S. Cl. ..... 51/97 NC; 51/101 LG

[58] Field of Search ..... 51/97 NC, 101 LG, 105 LG, 51/124, 284 E, 268, 269, 272, 97 R

[56] References Cited

U.S. PATENT DOCUMENTS 4,640,055 2/1987 Badin et al. ..... 51/101 LG
4,766,699 8/1988 Gottschald et al. ..... 51/101 LG
4,779,603 10/1988 Crocetti ..... 51/272

FOREIGN PATENT DOCUMENTS 1777393 3/1967 Fed. Rep. of Germany ..... 51/101 LG

*Primary Examiner*—Frederick R. Schmidt
*Assistant Examiner*—Mark F. Frazier
*Attorney, Agent, or Firm*—Martin Smolowitz

[57] ABSTRACT

The machine for grinding ophthalmic glasses comprises a housing (1) open in its upper part and housing a grinding wheel (7) driven in rotation on a first horizontal shaft (6), a U-shaped carriage (13) pivotally mounted on a second horizontal shaft (11) and located above and at the rear of the first horizontal shaft (6) and carrying between the wings of the carriage a shaft (14) in two parts which clamp therebetween a work piece (15) to be machined, the carriage being movable about and along the second shaft. The machine further comprises a hood (2) having a pivotal upper panel (5) and mounted in the housing (1) to be pivotable between an upper closing position and a lower opening position, a motor (20) for driving the hood, and a first device (26, 27) and a second device (24, 25) for raising the carriage and the panel respectively when the hood moves from its upper position to its lower position.

9 Claims, 3 Drawing Sheets

FIG. 1
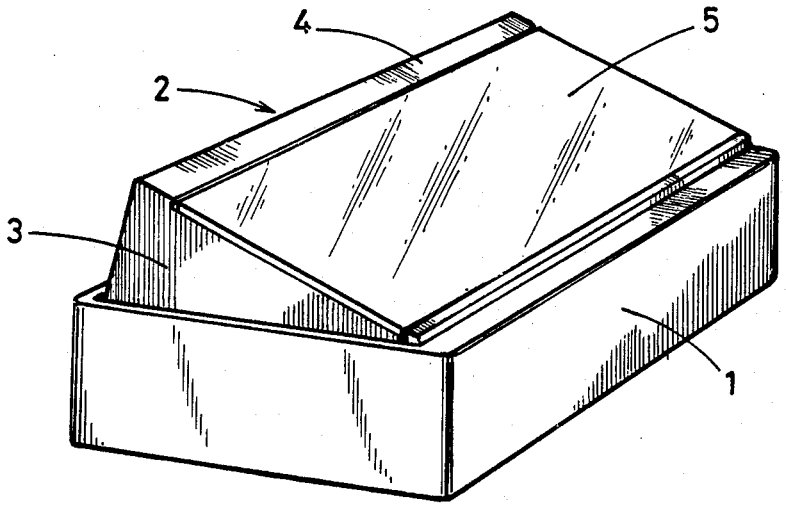
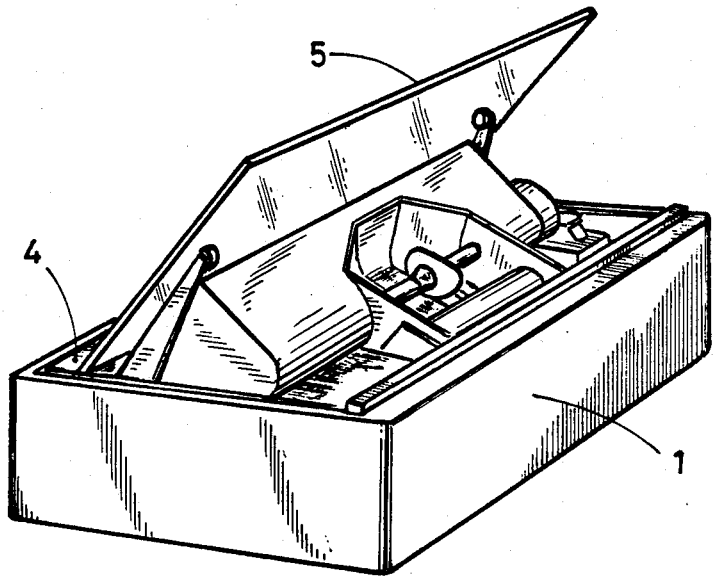
FIG. 2

GRINDING MACHINES

BACKGROUND OF THE INVENTION

The present invention relates to machines for grinding ophthalmic glasses.

A conventional machine for grinding ophthalmic glasses usually comprises a grinding wheel mounted on a rotative horizontal shaft and a carriage which is movable along a second horizontal shaft parallel to the first-mentioned shaft and is located above and at the rear of the latter.

The movable carriage has a generally U-shape. It is pivotally mounted on its shaft by its intermediate part, so that its parallel lateral wings extend in a direction perpendicular to the grinding wheel shaft and above the latter.

Extending between the lateral wings of the U-shaped carriage is a shaft in two parts between which is clamped a glass to be machined, and a template is mounted on one end of the shaft carrying the glass and bears against a key or abutment. The carriage is movable about its support shaft and along the latter for bringing the glass to be machined into contact with the grinding wheel and the template into contact with the control button.

A spraying rack sprays water onto the grinding wheel and the glass to be machined.

In the course of the grinding operation, the sprayed water forms a mist and splashes from which the operator is protected by a transparent mask disposed in front of the grinding wheel and the glass, or is protected by a removable and swingable cover which is also transparent.

SUMMARY OF THE INVENTION

An object of the invention is to provide a grinding machine of the aforementioned type which comprises means for protecting the operator from the splashing, these means opening automatically and simultaneously causing the raising of the carriage when the machining of the glass is finished.

The invention therefore provides a machine for grinding ophthalmic glasses, comprising a housing which has a substantially parallel-sided general shape and is open in its upper part and houses a grinding wheel driven in rotation on a first horizontal shaft, a generally U-shaped carriage pivotally mounted on a fixed second horizontal shaft and located above and at the rear of the first shaft and carrying between its lateral wings a shaft in two parts which clamp therebetween the glass to be machined, said carriage being movable about said second shaft and along said second shaft and said wings applying the glass against the grinding wheel by the effect of gravity, said machine further comprising a hood having an upper pivotal panel mounted in the housing to be pivotable between an upper closing position and a lower opening position, a motor for driving said hood, and first means and second means for raising the carriage and said panel respectively when the hood moves from the upper position to the lower position of the hood.

According to another feature of the invention, the hood comprises two parallel lateral walls interconnected by an intermediate portion on the edge of which intermediate portion the upper panel is pivotally mounted, this upper panel being transparent.

Advantageously, the hood is pivotally mounted on two trunnions mounted on the sides of the housing and engaged in apertures provided in the ends of said lateral walls.

In one embodiment, the motor for driving the hood is connected to the housing and drives through a speed reducer, a gear wheel engaged with a toothed sector, or a rack on one of said lateral walls.

In another embodiment, the motor for driving the hood is connected to the housing and drives, through a speed reducer, a link pivotally mounted on a lever connected to the hood.

Preferably, end-of-travel microswitches are provided for stopping the motor in the upper and lower position of the hood.

According to a further feature of the invention, said means for raising the carriage when the hood moves to its lower position comprise a projection on the hood which cooperates with an opposed projection on the carriage.

According to a still further feature, said means for raising the upper panel comprise at least one abutment carried by an arm connected to said housing.

Said arm is preferably formed by a fixed vertical extension of a support for the shaft carrying the carriage.

Conveniently, the motor for driving the hood is controlled by a-switch mounted on the housing.

DESCRIPTION OF THE DRAWINGS

The following description, with reference to the accompanying drawings given as non-limitative examples, will explain how the invention can be carried out.

FIG. 1 is a perspective view of a machine for grinding ophthalmic glasses according to the invention with its hood in the upper closing position;

FIG. 2 is a perspective view of the same machine with its hood in the lower opening position;

DESCRIPTION OF THE PREFERRED EMBODIMENTS

Figure 3:
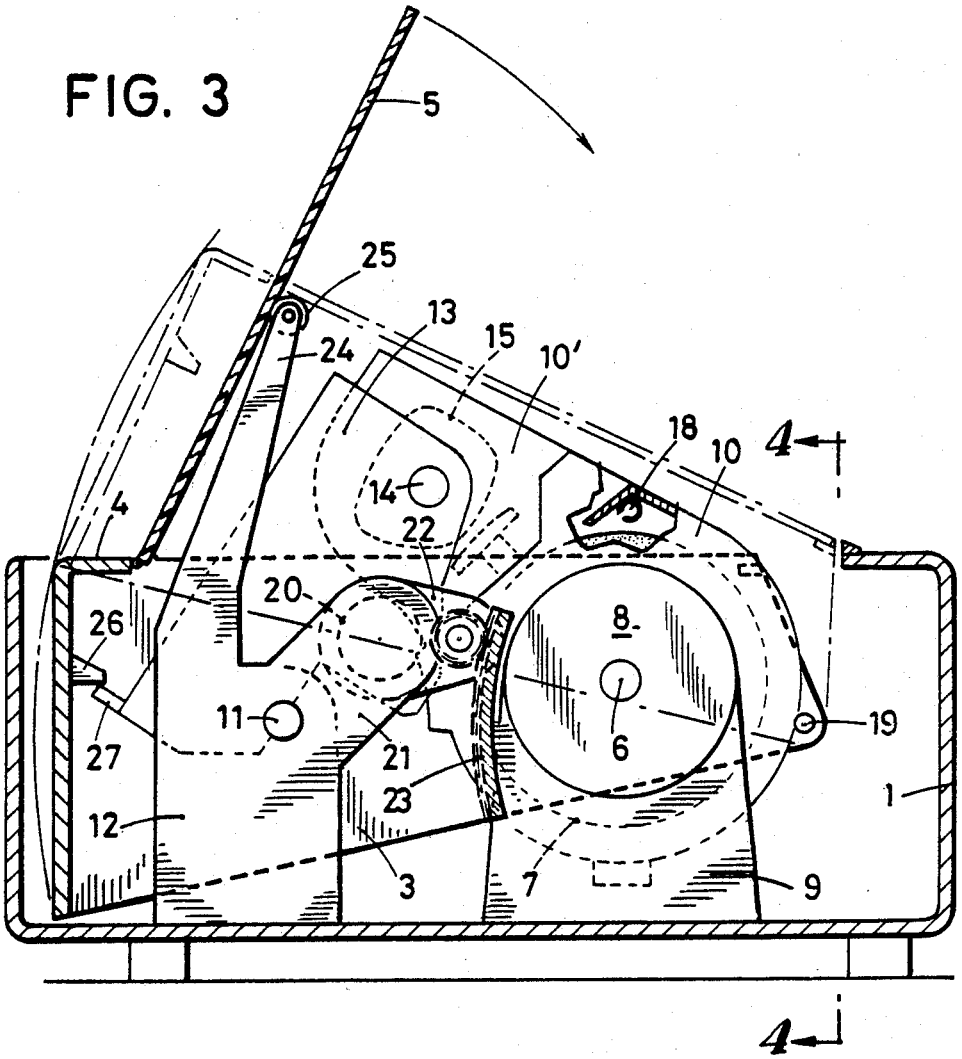
FIG. 3 is an end elevational view, partly in section taken at line 3—3, of FIG. 4, showing the grinding machine of FIGS. 1 and 2.

With reference to FIGS. 1 and 2, there is shown a machine for grinding ophthalmic glasses according to the invention which comprises a housing 1 having a generally parallel-sided shape (in the illustrated embodiment) and open in its upper part, this housing houses the mechanism of the machine and in which is pivotally mounted a hood 2 having two parallel lateral walls 3 interconnected by an intermediate portion 4 on the upper edge of which is pivotally mounted a transparent panel 5.

In the known way, the mechanism of the machine comprises a first rotative horizontal shaft 6 carrying a grinding wheel 7 and driven by a motor 8 carried by a support 9. Preferably, the grinding wheel 7 rotates in the lower upwardly open part of a secondary housing 10 in two parts for the purpose which will be explained hereinafter.

Mounted at the rear of the grinding wheel 7 and its driving motor 8 is a fixed second horizontal shaft 11 carried by two supports 12 and on which is pivotally mounted a generally U-shaped carriage 13.

The carriage 13 carries between its lateral wings a shaft 14 in two parts, between which is clamped a glass 15 to be ground. The arrangement is such that the carriage 13 is pivotal about the shaft 11 behind and above the grinding wheel 7, so as to apply the glass to be ground against the latter in the downward direction under the effect of gravity. Mounted on an extension of the shaft 14 is a template 16 located outside the carriage 13, this template also coming to bear downwardly against a control button or abutment 17.

Advantageously, the glass 15 rotates, between the wings of the carriage 13, in the downwardly open upper part 10' of the secondary housing 10.

Figure 4:
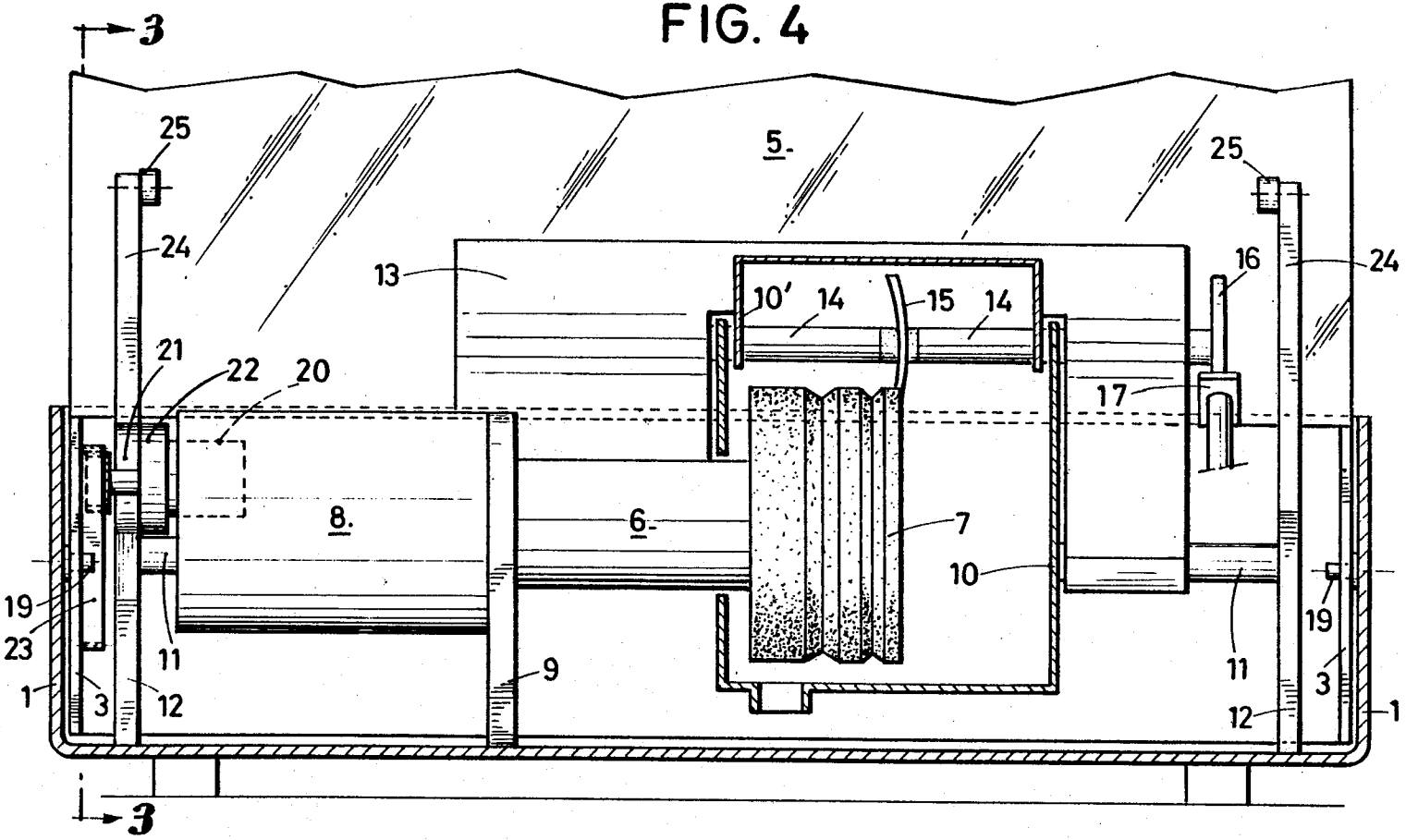
FIG. 4 is a sectional view taken on line 4—4 of FIG. 3.

The carriage 13 is therefore pivotable about the shaft 11 between a lower position shown in FIG. 4, in which the glass 15 is in contact with the grinding wheel 7 and/or the template 16 is in contact with the control button 17, and an upper position shown in FIG. 3 in which the glass is spaced away from the grinding wheel. In these two positions, the carriage 13 and the part 10' of the secondary housing 10 project upwardly out of the housing 1.

A rack 18 for distributing water is mounted in the hood 10 and connected to a water supply for the purpose of spraying a jet of water onto the grinding wheel and the edge of the glass 15 to be ground.

According to the invention, the intermediate portion 4 of the hood 2 is arranged to be parallel to the shaft 11 and on the side opposed to the grinding wheel relative to this shaft, and the hood 2 is pivotally mounted in the housing 1 by means of two trunnions 19 which are connected to the housing 1 and extend through corresponding apertures provided at the ends of the lateral walls of the hood 2, as shown in FIGS. 3 and 4, on two opposed sides of the housing 1.

With this arrangement, the hood 2 is vertically pivotable about the trunnions 19 between the lower position shown in full lines and the upper position shown in dot-dash lines in FIG. 3.

For the purpose of effecting this pivotable movement, a driving device is provided which comprises a motor 20 fixed to a tab 21 connected to one of the supports 12 of the carriage shaft 11 and extending toward the grinding wheel 7.

The motor 20 first of all drives a speed reducer unit 22 having an output gear wheel which drives a toothed sector or rack 23 fixed to the inner side of the corresponding lateral wall 3.

When the hood 2 is in the upper position shown in dot-dash lines, the panel 5 is swung over under the effect of its weight on top of the whole of the mechanism of the machine in the closing position.

In order to ensure the opening of this panel when the hood moves to the lower position, there is provided on each of the supports 12 of the shaft 11 an arm 24 which extends substantially vertically upwardly and carries at its upper end a roller 25. When the hood descends toward its lower position, the panel 5 encounters the rollers 25 which maintain it in the upper position by swinging it about its pivotal mounting on the upper edge of the intermediate portion of the hood 2.

Means are provided for raising the carriage from its lower position at the same time as the hood 2 moves from its upper position to its lower position.

For this purpose, a finger member 26 is provided on the inner surface of the intermediate portion of the hood 2 and projects in a direction toward the shaft 11 of the carriage, and a corresponding finger member 27 is provided on the rear part of the carriage and projects toward the intermediate portion of the hood in confronting relation to the finger member 26 (FIG. 3) and below the latter.

It will be understood that, when the hood 2 descends, its finger member 26 bears against the finger member 27 of the carriage and thus swings the latter upwardly.

Figure 5:
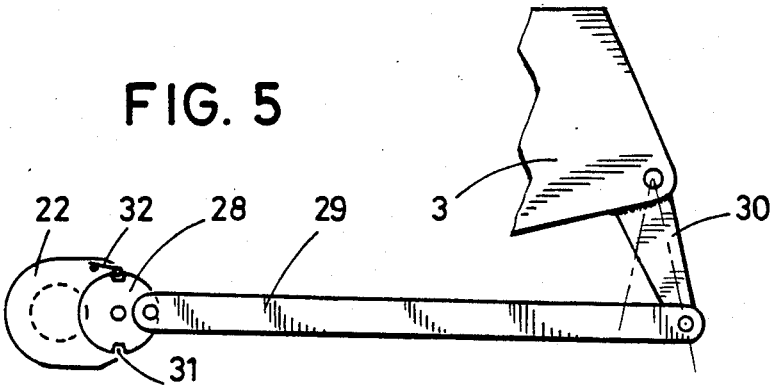
FIG. 5 is a detail view of a variant of the hood-driving means.

FIG. 5 shows a variant of the means for driving the hood by the motor 20. In this variant, the output element of the speed reducer 22 is a wheel 28 on which is pivotally mounted one end of a link 29 whose other end is pivotally mounted on a tab 30 fixed to one end of the corresponding lateral wall 3.

The wheel 28 defines on its periphery two diametrically opposed recesses 31 and there is provided a microswitch 32 which is elastically yieldably engaged with one of the recesses 31, the function of this microswitch being to control the operation and the stoppage of the motor 20 in the upper and lower positions of the hood 2.

What is claimed is:

1. Machine for grinding opthalmic glass comprising a first horizontal shaft, a fixed second horizontal shaft located rearwardly of said first shaft, a grinding wheel mounted on the first shaft, means for driving in rotation a grinding wheel on the first shaft, a carriage having a generally substantially U-shape defining two wings and pivotally mounted on the second shaft and located above and at the rear of the first shaft, a third shaft having two shaft parts carried by the carriage between the wings of the carriage for gripping between the two shaft parts a glass piece to be machined, the carriage being movable about and along the second shaft and the wings being operative to apply the glass against the grinding wheel under the effect of gravity, a housing having a generally substantially parallel-sided shape and defining an opening in an upper part of the housing, said housing containing said shafts, carriage, and grinding wheel, said machine further comprising a hood, an upper panel pivotally mounted on the hood, the hood being mounted in the housing to be pivotable between an upper closing position and a lower opening position, a motor for driving the hood, a first means and a second means for raising the carriage and the panel respectively when the hood moves from the upper position to the lower position of the hood.

2. Machine according to claim 1, wherein the hood comprises two parallel lateral walls and an intermediate portion interconnecting the lateral walls, the intermediate portion having an edge portion on which edge portion the upper panel is pivotally mounted, the upper panel being transparent.

3. Machine according to claim 2, comprising trunnions connected to sides of the housing, apertures provided in end portions of the lateral walls of the hood for pivotally mounting the hood on the housing.

4. Machine according to claim 1, wherein the motor is connected to the housing and the machine further comprises in combination a speed reducer, a toothed sector or rack on one of said lateral walls, a gear wheel engaged with said sector or rack, the motor driving the hood through the speed reducer, the gear wheel and the toothed sector or rack.

5. Machine according to claim 1, wherein the motor is connected to the housing and the machine further comprises in combination a speed reducer, an arm connected to the hood and a link pivotally mounted on the arm, the motor driving the hood through said speed reducer, said link and said arm.

6. Machine according to claim 5, further comprising end-of-travel microswitches for stopping the motor in the upper and lower positions of the hood.

7. Machine according to claim 1, wherein said means for raising the carriage when the hood moves to the lower position thereof comprise a first projection on the hood, an opposed projection on the carriage with which opposed projection the first projection cooperates.

8. Machine according to claim 1, wherein said means for raising the upper panel comprise at least one abutment constituted by a roller and a vertical arm connected to the housing and carrying the roller.

9. Machine according to claim 8, further comprising a support for the second shaft carrying the carriage and a fixed vertical extension of said support constituting said arm.

* * * * *